US009341442B1

(12) United States Patent
Geissele

(10) Patent No.: US 9,341,442 B1
(45) Date of Patent: May 17, 2016

(54) KNIFE MOUNT FOR A FIREARM

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 14/840,945

(22) Filed: Aug. 31, 2015

(51) Int. Cl.
*F41C 27/18* (2006.01)

(52) U.S. Cl.
CPC ..... *F41C 27/18* (2013.01)

(58) Field of Classification Search
CPC ..... F41C 27/18; F41C 27/16; F41C 27/00
USPC ..... 42/90, 86, 53, 106
See application file for complete search history.

(56) References Cited

U.S. PATENT DOCUMENTS 1,002,115 A * 8/1911 Barnes ..... F41C 27/18 42/86
1,121,589 A * 12/1914 Johnson ..... F41C 27/18 42/86
2,330,637 A * 9/1943 Spagnolo ..... F41C 27/18 42/86
2,333,379 A * 11/1943 Johnson, Jr. ..... F41C 27/18 42/86
2,367,212 A * 1/1945 Haag ..... F41C 27/18 42/86
3,076,280 A * 2/1963 Bervoets ..... F41C 27/18 42/86
6,385,892 B1 * 5/2002 Vendetti ..... F41C 27/00 42/86
7,559,167 B1 * 7/2009 Moody ..... F41G 11/003 42/71.01
D610,222 S * 2/2010 Moore ..... D22/108
D610,223 S * 2/2010 Moore ..... D22/108
7,861,451 B1 * 1/2011 Moody ..... F41A 23/08 42/71.01
7,987,623 B1 * 8/2011 Moody ..... F41A 23/08 42/71.01
8,245,428 B2 * 8/2012 Griffin ..... F41C 23/16 42/72
8,341,866 B1 * 1/2013 Gaddini ..... F41G 11/003 42/71.01
8,393,104 B1 * 3/2013 Moody ..... F41C 23/14 42/71.01
9,107,482 B1 * 8/2015 Boelter ..... A45B 3/00
D742,472 S * 11/2015 Ledet ..... D22/118
2005/0217161 A1 * 10/2005 Haugen ..... F41C 27/00 42/124
2011/0214329 A1 * 9/2011 Green ..... F41C 27/00 42/90
2014/0215887 A1 * 8/2014 Luckey ..... F41G 11/003 42/90
2014/0230303 A1 * 8/2014 Rice ..... F41C 27/16 42/90

* cited by examiner

*Primary Examiner* — Joshua Freeman
(74) *Attorney, Agent, or Firm* — Merchant & Gould, PC

(57) ABSTRACT

A mount for securing a knife to a firearm rail for use of the knife, e.g., to engage a target at close range.

20 Claims, 11 Drawing Sheets

KNIFE MOUNT FOR A FIREARM

BACKGROUND

Securing a knife (e.g., a bayonet) to a firearm for close range engagement of a target typically requires mounting the knife's handle to the barrel and/or a mounting surface on a front site mounted to the barrel. There is a need for a device that facilitates mounting a knife to a firearm.

SUMMARY

In general terms this disclosure is directed to a mount for securing a knife to a firearm.

In one aspect, a knife mount for a firearm comprises an elongate member defined by a front end and a back end; a knife engagement portion disposed on the elongate member; and a rail engagement surface disposed on the elongate member, the rail engagement surface being configured to be removably secured to a firearm rail.

In another aspect, a firearm comprises a barrel; a rail disposed about the barrel; a knife; and a knife mount, the knife mount comprising an elongate member defined by a front end and a back end, a knife engagement portion, and a rail engagement surface disposed on the elongate member, the rail engagement surface being configured to be removably secured to the rail, and the knife engagement portion being configured to be removably secured to the knife.

In a further aspect, a firearm comprises: a barrel; a rail disposed about the barrel; and a knife mount, the knife mount comprising an elongate member defined by a front end and a back end, a first knife engagement portion disposed at a first portion of the elongate member, a second knife engagement portion disposed at a second portion of the elongate member, and a rail engagement surface disposed on the elongate member, the rail engagement surface being configured to be removably secured to the rail, and the knife engagement portion being configured to be removably secured to a knife, the knife mount further comprising a torque balancing bar disposed above the rail engagement surface, the rail being removably sandwiched between the torque balancing bar and the rail engagement surface, and the bar being pivotally coupled to the elongate member.

DETAILED DESCRIPTION

Figure 1:
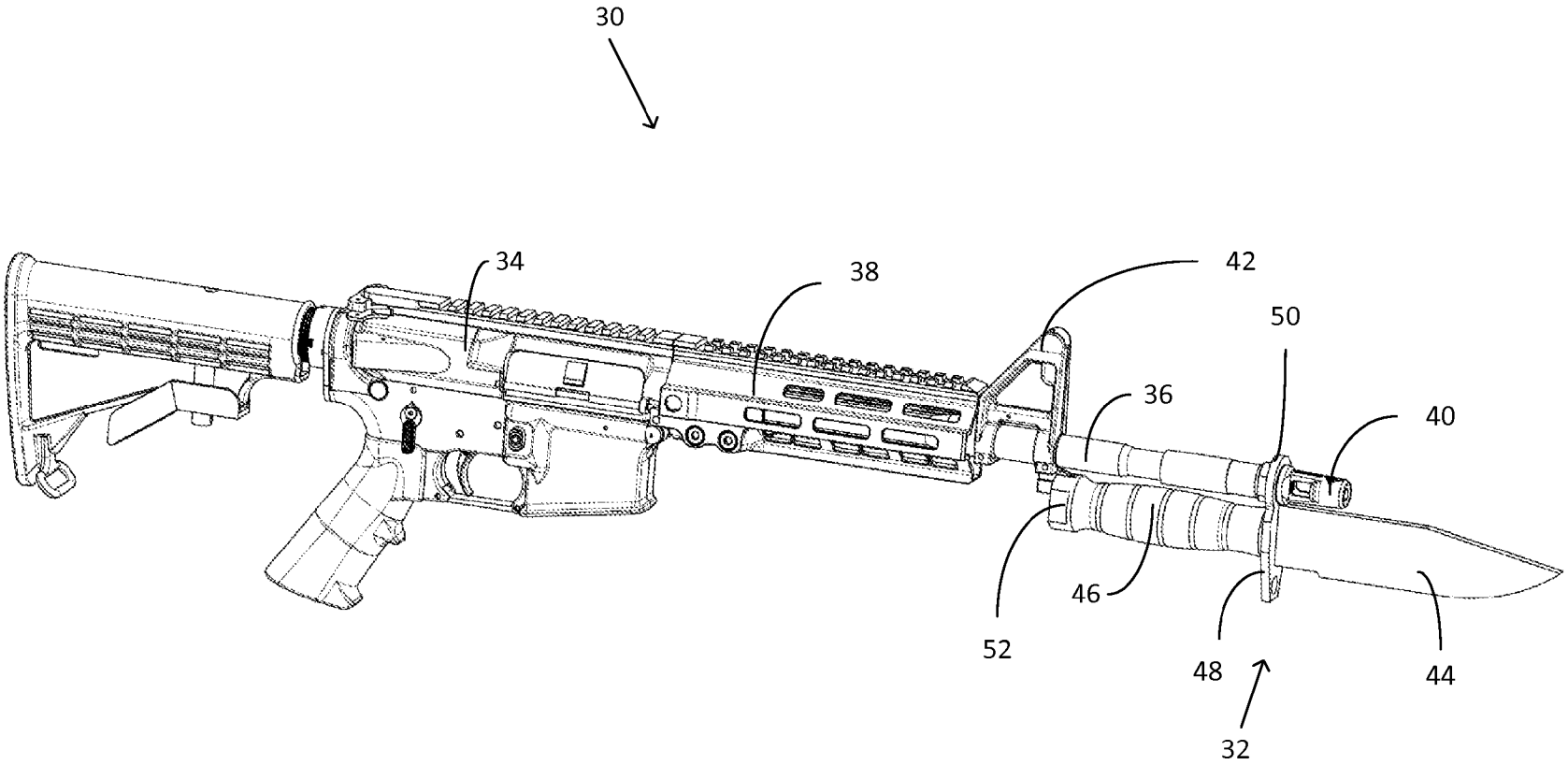
Fig. 1 PRIOR ART
FIG. 1 is a perspective view of a firearm assembly including a knife conventionally mounted to the firearm assembly.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of a firearm assembly 30 including a knife conventionally mounted to the firearm assembly. The firearm assembly 30 includes a receiver 34, a barrel 36, a rail 38, a muzzle brake 40, and a front sight 42. The knife 32 includes a blade 44, a handle 46, a crosspiece 48 having a muzzle ring 50, and a front sight mounting portion 52. The barrel 36, which provides a passageway for projectiles fired from the receiver 34 to exit the firearm assembly 30 towards a target, extends forwards from the front of the receiver 34, the barrel 36 forwardly terminating at a muzzle to which the muzzle brake 40 is attached, the muzzle brake 40 providing a dissipating effect to the recoil force and/or noise that accompanies firing of the firearm assembly 30. The rail 38 is secured to the barrel with a barrel nut, the rail 38 rearwardly abutting the receiver 34 and extending forwards from the receiver 34. The rail 38 is disposed about a relatively short portion of the barrel 36, allowing the front sight 42 (primarily used for aiming the firearm assembly 30 at a target) to be mounted to the barrel 36 in front of the rail 38. The crosspiece 48 is disposed between the blade 44 (the blade being configured for destructively engaging a target) and the handle 46. The muzzle ring 50 extends upward from the crosspiece 48 and is configured to receive a portion of the barrel 36 (e.g., the muzzle of the barrel 36). As shown in FIG. 1, the muzzle ring 50 engages the barrel 36, providing a support point for securing the knife 32 onto the firearm assembly 30. The front sight mounting portion 52 is a rearward extension of the handle 46 and is configured to mate with a mounting surface of the front sight 42, as shown in FIG. 1, thereby providing a second support point for securing the knife 32 onto the firearm assembly 30. The positioning of the two support points for the knife 32 is such that a portion of the blade 44 extends forwards beyond the forward end of the barrel 36 and the muzzle brake 40 for engaging a target with the blade 44. In order to mount the knife 32 as shown in FIG. 1, it is essential that the length of the rail 38 be sufficiently short to permit mounting of the front sight 42 to the barrel 36, since the knife 32 must be partially secured to the front sight 42. A sufficiently long portion of the barrel 26 that is not surrounded by the rail 38 is required to mount the front sight 42 to the barrel 26, and thereby to secure the knife 32 to the front sight 42 as shown in FIG. 1.

Figure 2A:
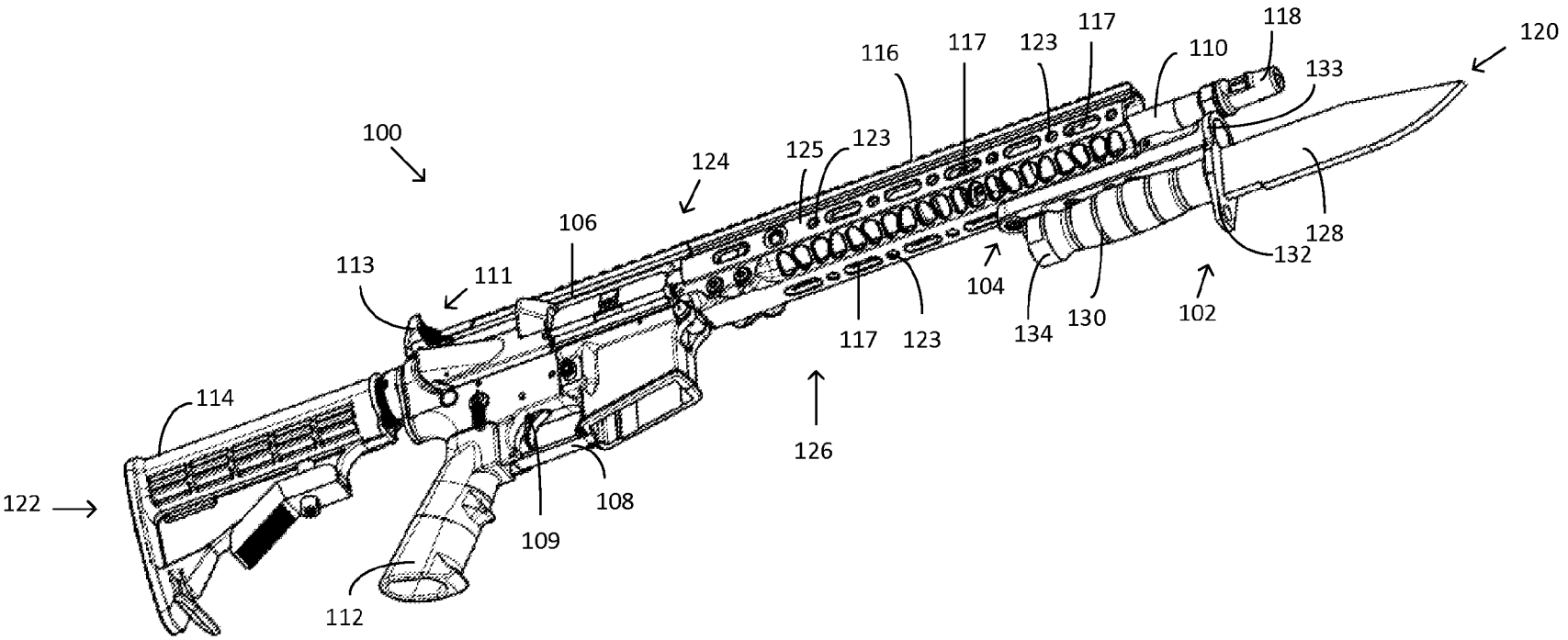
FIG. 2A is a perspective view of an example firearm and knife, including an example knife mount in accordance with the present disclosure.
Figure 2B:
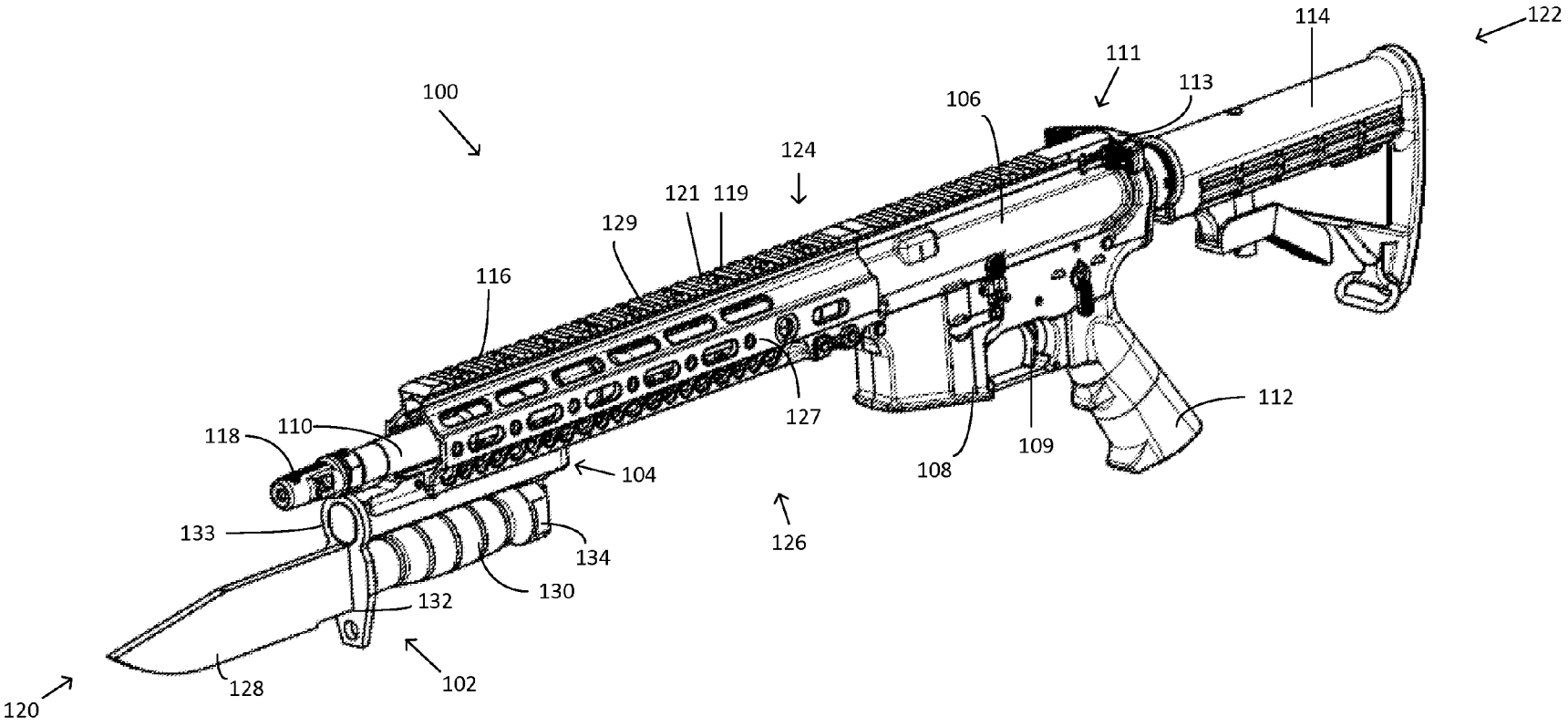
FIG. 2B is a further perspective view of the example firearm, knife and knife mount of FIG. 2A.

FIG. 2A is a perspective view of an example firearm 100 and knife 102, including an example knife mount 104 in accordance with the present disclosure. FIG. 2B is a further perspective view of the example firearm 100, the knife 102, and the knife mount 104 of FIG. 2A.

With reference to FIGS. 2A-2B, the firearm 100 includes an upper receiver 106, a lower receiver 108, a barrel 110, an optional charging handle 111, a grip 112, optionally a stock 114, a rail 116, and optionally a muzzle brake 118. The firearm 100 is defined by a front 120, a back 122, a top 124 and a bottom 126. Throughout this disclosure, references to orientation (e.g., front(ward), rear(ward), in front, behind, above, below, high, low, back, top, bottom, under, underside, etc.) of structural components shall be defined by that component's positioning in FIG. 2A relative to, as applicable, the front 120, the back 122, the top 124, and the bottom 126 of the firearm 100, regardless of how the firearm 100 may be held and regardless of how that component (e.g., the knife 102, the knife mount 104) may be situated on its own (i.e., separated from the firearm 100). The knife 102 includes a blade 128 and optionally, a handle 130, a crosspiece 132 a ring 133, and a rear mounting portion 134. With reference to FIG. 2A, the rail 116 includes a right side 125; with reference to FIG. 2, the rail includes a left side 127 and a top side 129.

In some examples, the firearm 100 is configured to have a plurality of operating modes. Examples of operating modes include a normal mode and a semi-automatic mode. In normal mode, the firearm 100 discharges a round of ammunition following activation of a trigger mechanism. To reset the trigger mechanism to fire another round of ammunition, the user manually actuates the charging handle 111. In semi-automatic mode, the trigger mechanism automatically resets after firing each round of ammunition without needing to actuate the charging handle 111, and without the need to include a charging handle 111 on the firearm 100.

The firearm 100 can be of a variety of types. Examples of a firearm include handguns, rifles, shotguns, carbines, and personal defense weapons. In at least one embodiment, the firearm 100 is implemented as an M4 carbine or a variant of an M4 carbine.

The upper receiver 106 of the firearm 100 is configured to house a bolt assembly. In a typical firearm 100, the bolt assembly is slidably disposed in the upper receiver 106 for axially reciprocating recoil movement therein during the firing cycle sequence of the firearm 100. The barrel 110 is mated to the upper receiver 106, and the upper receiver 106 is in open communication with the barrel 110. During a firing cycle a firing pin carried by a bolt in the bolt mechanism is thrust forward to contact and discharge a cartridge loaded in a chamber in the upper receiver 106. A projectile (e.g., a bullet) from the cartridge then travels through the barrel 110 and exits the firearm 100 at the front end (i.e., the muzzle) of the barrel 110 towards a target. The spent cartridge is ejected from the upper receiver 106 either automatically, or manually upon actuation of the charging handle 111.

The lower receiver 108 houses a trigger mechanism configured to initiate the firing cycle sequence of the firearm 100 when a predetermined amount of force is applied to the trigger bow 109. A magazine containing one or more rounds of ammunition (not shown) is coupled to the lower receiver 108 for depositing rounds of ammunition in the chamber of the upper receiver for each sequential firing cycle of the firearm 100.

The barrel 110 is positioned at the front 120 of the firearm 100 and is configured to be installed to the upper receiver 106. The barrel 110 provides a path to release an explosion gas and propel a projectile therethrough. The barrel 110 includes an accompanying assembly that includes one or more of a rail system (e.g., the rail 116) for mounting accessories (e.g., a fore-grip, a flashlight, a laser, optic equipment).

The charging handle 111 is slidably disposed within the upper receiver 106. A front portion of the charging handle 111 engages the bolt assembly within the upper receiver 106. A rear portion of the charging handle 111 is exterior to the upper receiver 106 and includes a hand engagement portion 113 for actuating the charging handle 111.

The grip 112 provides a point of support for the shooter of the firearm and can be held by the shooter's hand, including when operating a trigger mechanism. The grip 112 assists the shooter in stabilizing the firearm 100 during firing and manipulation of the firearm 100. In some embodiments, the grip 112 is mounted to the lower receiver 108.

The stock 114 can be of a variety of shapes and configurations. The stock 114 is disposed behind the upper receiver 106. During typical operation of the firearm 100, the stock 114 rests against the body of the shooter, channeling recoil energy generated from exploding gases during the firing cycle to the body of the shooter. Optionally, the stock 114 contains an energy absorbing mechanism, such as a buffer tube.

The rail 116 (also known as a handguard) surrounds at least a portion of the barrel 110 and functions as a support for the user's front hand when firing the firearm 100. The rail 116 may also act to prevent the user's hand from getting burned by the barrel 110, which can become extremely hot when the firearm 100 is being fired. As discussed above, the rail 116 may also be used for mounting accessories (e.g., a fore-grip, a flashlight, a laser, optic equipment). Typically a rear portion of the rail 116 is mounted to the barrel 110 (e.g., with a barrel nut) such that the rail 116 abuts the front of the upper receiver 106. In some examples, the rail 116 includes apertures 117 running along the longitudinal length of the rail 116. The apertures 117 reduce the weight of the rail 116 and also serve as heat vents, allowing heat radiating from the barrel 110 as a result of shooting the firearm 100 to escape, thereby preventing excessive heat build-up between the rail 116 and the barrel 110. In this example, a top surface of the rail 116 includes mounting ribs 119 that alternate with grooves 121 (FIG. 2). The mounting ribs 119 with their corresponding grooves 121 provide a platform for mounting firearm accessories having corresponding ribs and grooves that engage the grooves 121 and mounting ribs 119, respectively, of the rail 116. In one example, the mounting ribs 119 are standard dimension such as a "Picatinny" style mounting platform, also known as MIL-STD-1913. The rail 116 also includes a plurality of fastener holes 123. The fastener holes 123 are configured to receive fasteners for securing one or more accessories to the rail 116. In some examples, the fastener holes 123 are threaded in order to receive correspondingly threaded screw fasteners.

The muzzle brake 118 is coupled to the front end of the barrel 110 and functions to redirect gases exiting the front of the barrel 110 during a firing cycle to reduce recoil, "kick," and/or the noise associated with firing the firearm 100.

The knife 102 can be of a variety of types, such as combat knives, tactical knives, utility knives and so forth. Non-limiting specific examples of the knife 102 include fixed blade knives, daggers, folding knives and bayonets. The knife 102 is secured to the knife mount 104, which is in turn secured to the rail 116 of the firearm 100. The blade 128 is configured as a weapon for engaging (e.g., harming, destroying, killing) a target. The handle 130 may be held in the user's hand for conventional knife wielding (i.e., when the knife 102 is separated from the firearm 100). The crosspiece 132 abuts the blade 128 on a front side of the crosspiece 132 and the handle 130 on a rear side of the crosspiece 132. The ring 133 forms an upper portion of the crosspiece 132. In some examples the ring 133 is a muzzle ring configured to receive the muzzle of a firearm (or another portion of the barrel of a firearm) therethrough for mounting the knife 102 to the barrel of a firearm. The rear mounting portion 134 rearwardly abuts the handle 130. In some examples, the rear mounting portion 134 is configured to mate directly to a firearm barrel or to a projection extending directly from the barrel (e.g., a mounting surface on a front sight) specially configured for mating with the rear mounting portion 134.

The knife mount 104 is partially disposed in a space between the barrel 110 and the rail 116. In some examples, the knife 102 is secured to the rail 116 via the knife mount 104 such that at least a portion of the knife 102 extends frontwards beyond the front of the barrel 110 of the firearm 100 and, if a muzzle brake 118 is secured to the barrel 110, the knife 102 is secured to the rail 116 via the knife mount 104 such that at least a portion of the knife 102 extends frontwards beyond the muzzle brake 118. Projection of the knife 102 in this fashion facilitates target engagement with the knife 102 at close range, enabling the shooter to attack a target at close range by thrusting the firearm 100 forwards (e.g., in a stabbing motion) such that the knife 102 engages the target. The knife 102 and the knife mount 104 will be discussed in greater detail below.

Figure 3:
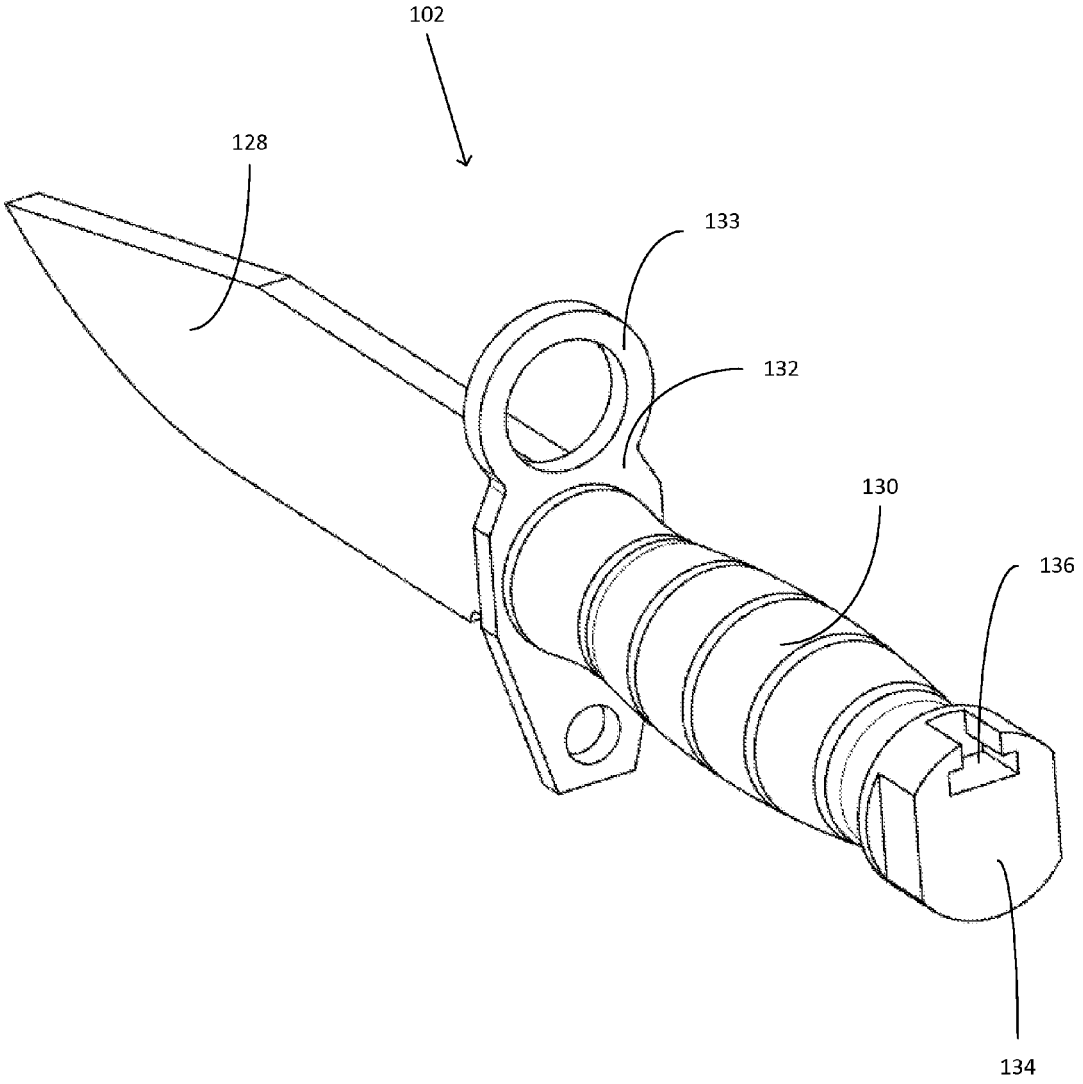
FIG. 3 is a perspective view of the knife of FIG. 2A.
Figure 4:
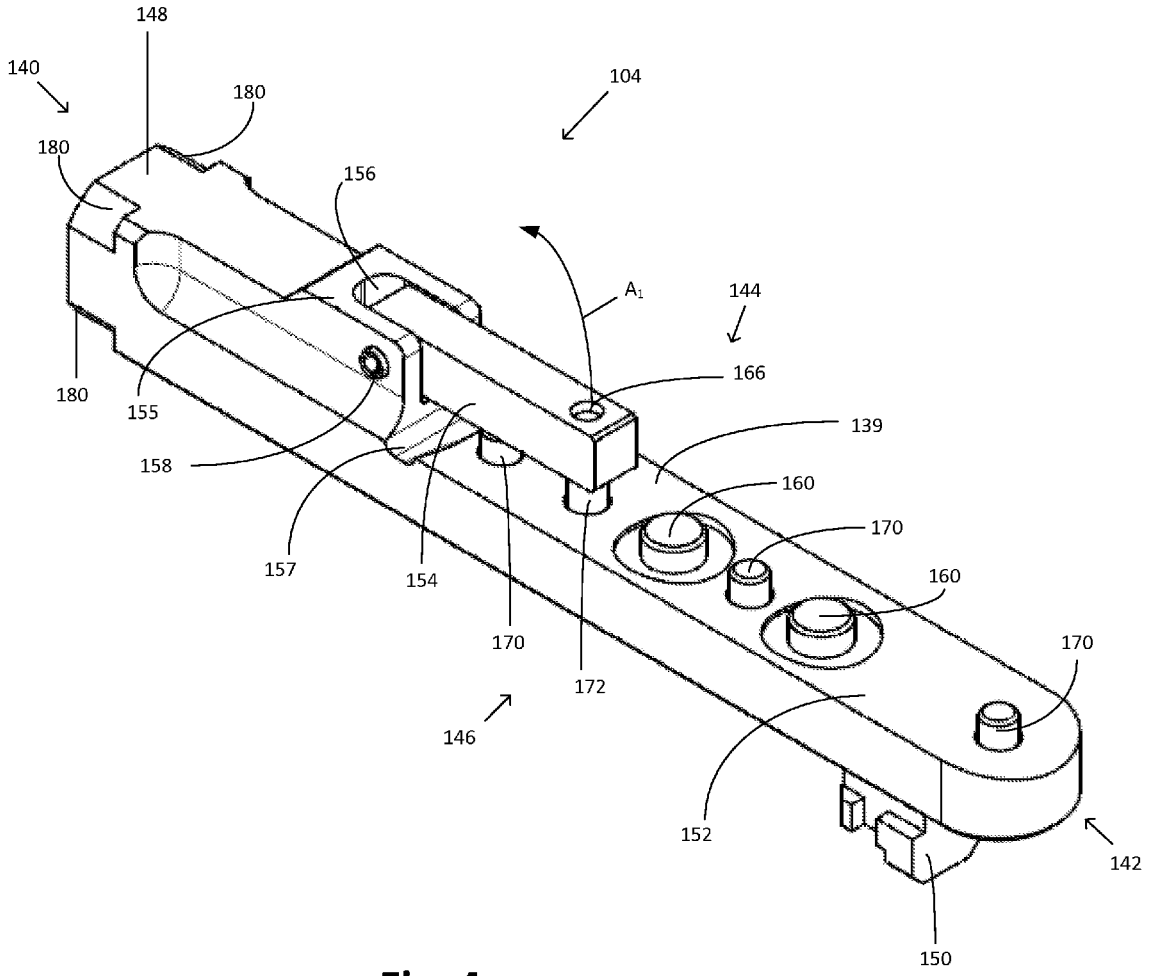
FIG. 4 is a perspective view of the knife mount of FIG. 2A.

FIG. 3 is a rear perspective view of the knife 102 of FIG. 2A. The knife 102 includes the blade 128, the handle 130, the crosspiece 132, the ring 133, and the rear mounting portion 134 as discussed above. In addition, in this example, the rear mounting portion 134 includes a notch 136. The notch 136 is configured as the female member of a male-female attachment between the rear mounting portion 134 and a rear knife engagement portion 150 (FIG. 4) of the knife mount 104 (FIG. 4). In some examples, the notch 136 is also the female member of a male-female coupling between the rear mounting portion 134 and a projection extending directly from a firearm barrel that is specially configured for mating with the rear mounting portion 134 of the knife 102.

Figure 5:
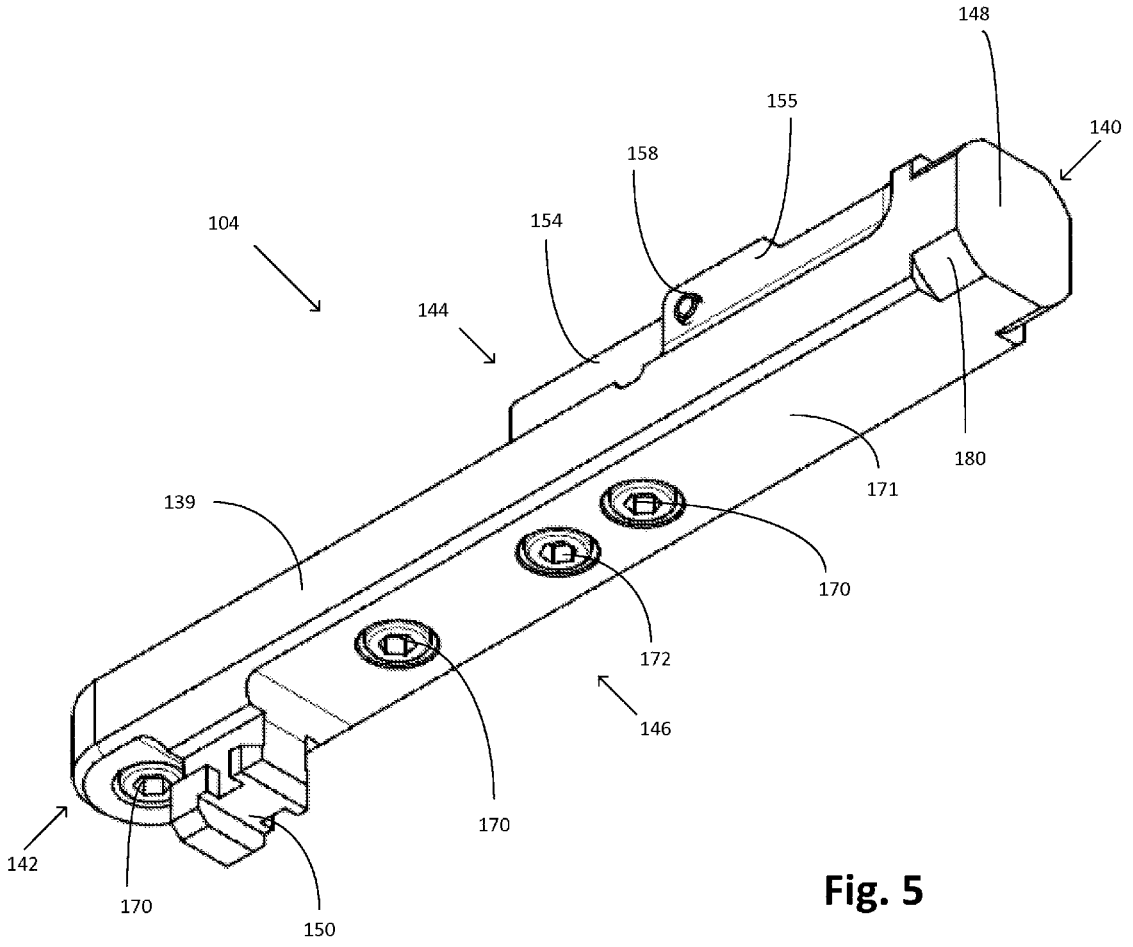
FIG. 5 is a further perspective view of the knife mount of FIG. 2A.
Figure 6:
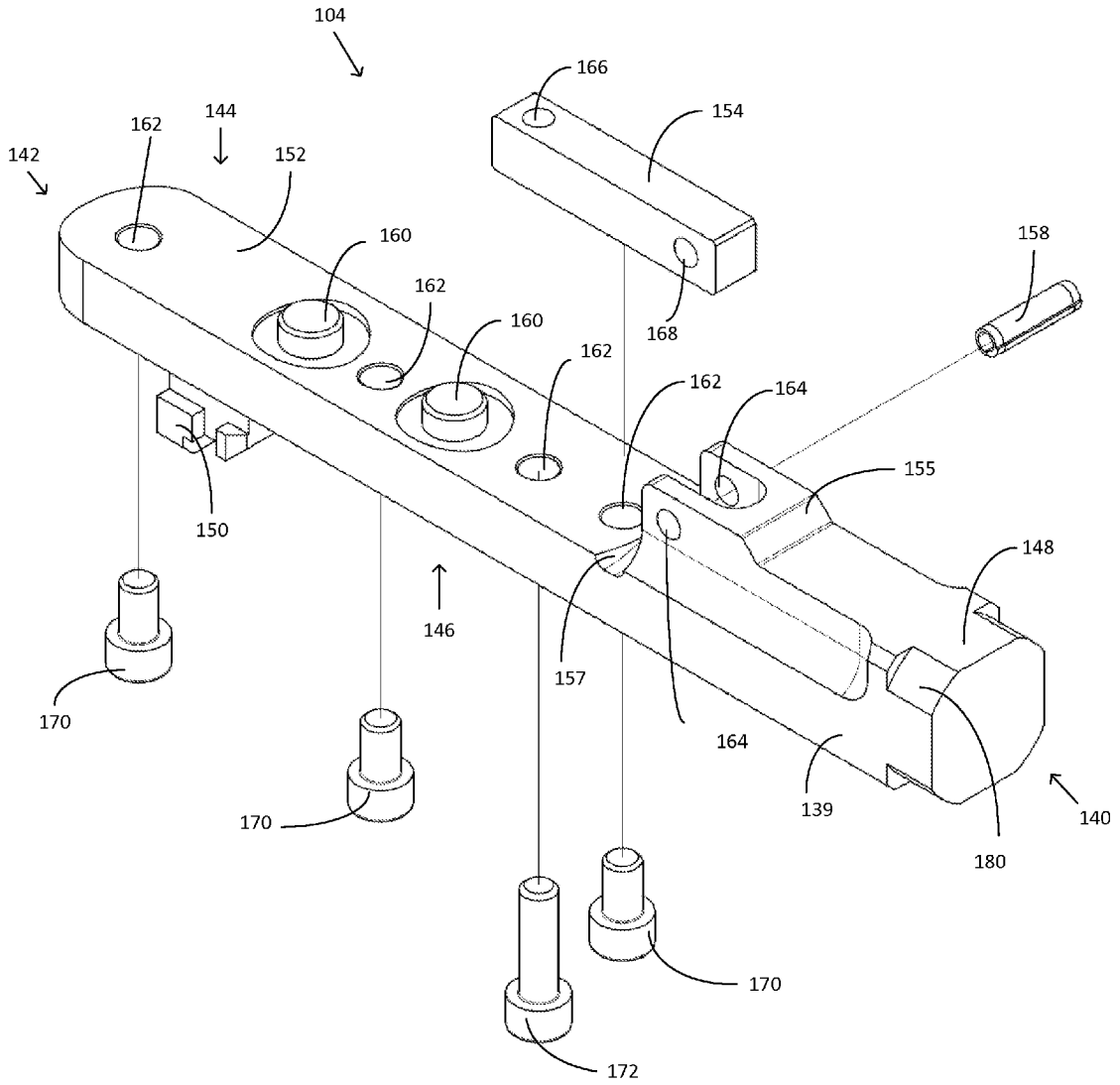
FIG. 6 is an exploded view of the knife mount of FIG. 2A.

FIG. 4 is a perspective view of the knife mount 104 of FIG. 2A. FIG. 5 is a further perspective view of the knife mount 104 of FIG. 2A. FIG. 6 is an exploded view of the knife mount 104 of FIG. 2A.

With reference to FIGS. 4-6, the knife mount 104 enables a knife (e.g., the knife 102 of FIG. 3) to be secured for engagement with a target directly to a firearm rail (e.g., the firearm rail 112 of FIG. 2A), such that the knife need not be secured to the barrel or a barrel accessory (e.g., a front sight). Thus, for example, the knife mount 104 enables mounting of a knife to a firearm even if the firearm does not have a front sight or cannot support a front sight (e.g., because it has a rail that is too long, as discussed above).

The knife mount 104 includes an elongate member 139, a front end 140, a back end 142, a top 144, a bottom 146, a front knife engagement portion 148, a rear knife engagement portion 150, a rail engagement surface 152, a torque support 154, a torque support mounting portion 155, a recess 156, a groove 157, a pin 158, one or more protrusions 160, one or more fastener holes 162 (FIG. 6), and pin receivers 164 (FIG. 6). In addition, the torque support 154 includes a fastener hole 166 and a bore 168 (FIG. 6). A plurality of first fasteners 170 and a second fastener 172 are also shown. The knife mount 104 has a bottom surface 171 (FIG. 5).

The elongate member 139 defines the longitudinal length of the knife mount 104 from the front end 140 to the back end 142. The front knife engagement portion 148 engages a portion of a knife (e.g., the knife 102 in FIG. 2A). In some examples, the front knife engagement portion 148 is a forwardly projecting projection at the front end 140 of the elongate member 139 that is configured to removably house (e.g., via a frictional fit) a corresponding receiving portion of a knife (e.g., the ring 133 in FIG. 2A). The example front knife engagement portion 148 shown in FIG. 5 includes a plurality of curved surfaces 180 adapted to correspond to the dimensions and curvature of the ring 133 (FIG. 2A).

The rear knife engagement portion 150 is disposed rearward of the front knife engagement portion 148 and is configured to engage a knife (e.g., the knife 102 in FIG. 2A) at a location on the knife that is rearward of an engagement with the front knife engagement portion 148. Thus, the front knife engagement portion 148 and the rear knife engagement portion 150 together provide two points of support for securing a knife to the knife mount 104. In the example shown, the rear knife engagement portion 150 is a projection extending downwardly from the bottom surface 171 (FIG. 5) of the elongate member 139 and configured to releasably engage a rear mounting portion of a knife (e.g., by being removably inserted in, and frictionally cooperating with, the notch 136 of the rear mounting portion 134 of the knife 102 in FIG. 3).

At least a portion of the rail engagement surface 152 is configured to abut a side (e.g., the bottom) of a firearm rail (e.g., the rail 116 of FIG. 2A) when the knife mount 104 is secured to the firearm rail. In the example knife mount 104 shown, the rail engagement surface 152 is a concave arcuate surface that cooperates with a correspondingly convex arcuate surface on a firearm rail (e.g., the rail 116 of FIG. 2A), providing a nesting cooperation between the rail engagement surface 152 and the firearm rail.

The torque support 154 is situated and configured to sandwich a portion of a firearm rail (e.g., the rail 116 of FIG. 2A) between the rail engagement surface 152 and the torque support 154. The torque support 154 is a bar configured to apply a downward force on a firearm rail (e.g., the rail 116) and thereby balance the torque experienced by the knife mount 104 as a result of the weight of a knife (e.g., the knife 102 of FIG. 2A), the weight of the knife mount 104, and/or other forces (such as forces generated when using the knife to engage a target). Thus, the torque support 154 can reduce undesirable shifting or movement of the knife mount 104 relative the firearm 100 (FIG. 2A), and thereby reduce undesirable shifting or movement of the knife 102 (FIG. 2A) relative to the firearm 100 (FIG. 2A).

The torque support mounting portion 155 is disposed forward of, and higher than, the rail engagement surface 152. A recess 156 in the torque support mounting portion 155 houses a forward portion of the torque support 154. The torque support 154 pivotally couples to the torque support mounting portion 155 via a pin 158 inserted through the pin receivers 164 (FIG. 6) and the bore 168 (FIG. 6), the pin receivers 164 being through holes on either side of the torque support 154 and aligned with the bore 168. When the forward portion of the torque support 154 is free (i.e., not directly coupled to the knife mount 104 (discussed below)), the torque support 154 is pivotable about the pin 158 in the direction of the arrow $A_1$ in FIG. 4, thereby facilitating installation and removal of the knife mount 104 to or from, respectively, a rail (e.g., the rail 116 of FIG. 2A). For example, to remove the knife mount 104 from a rail, the torque support 154 is pivoted away from an interior surface of the rail such that the rail is no longer sandwiched between the torque support 154 and the rail engagement surface 152.

The groove 157 may facilitate removal of the knife mount 104 from a rail (e.g., the rail 116 of FIG. 2A) by providing a space in which the knife mount can pivot around the forward edge of the firearm rail (see FIG. 7) without contacting the forward edge of the firearm rail, when removing the knife mount 104 from the rail.

The one or more protrusions 160 (e.g., shear lugs) extend upward from the rail engagement surface and are configured to be inserted and thereby engage apertures (e.g., the apertures 117 of FIG. 2A) in the underside of a rail (e.g., the rail 116 of FIG. 2A). The engagement can be a loose or frictional fit and provides additional support that reduces movement of the knife mount 104 (and thereby a knife secured to the knife mount 104) relative to the rail.

One or more fastener holes 162 extend through the elongate member 139 from the underside thereof through the rail engagement surface 152. The fastener holes receive the first fasteners 170 and the second fastener 172, which then pass through corresponding fastener holes in the rail (e.g., the rail 116 of FIG. 2A) to secure the knife mount 104 to the rail. In some examples, the first fasteners 170 and the second fastener 172 are screws that removably engage corresponding threads in the fastener holes 162 and in corresponding aligned fastener holes in the rail. In some examples, the second fastener 172 is a screw that is longer than the first fasteners 170, the second fastener 172 removably extending from the underside of the knife mount 104 through a fastener hole 162, through a corresponding fastener hole in a rail (e.g., the rail 116 of FIG. 2A) and into the fastener hole 166 (FIG. 6) (which may also be threaded) disposed in the torque support 154, thereby securely sandwiching the rail between the torque support 154 and the rail engagement surface 152, as discussed above. The number and spacing of the fastener holes 162 may be varied in accordance with the configuration of the rail being used and the amount and location of engagement desired between the knife mount 104 and the rail. It should also be noted that the knife mount 104 may be secured to a rail in any suitable fashion, e.g., as discussed below in connection with FIGS. 8 and 9.

Figure 7:
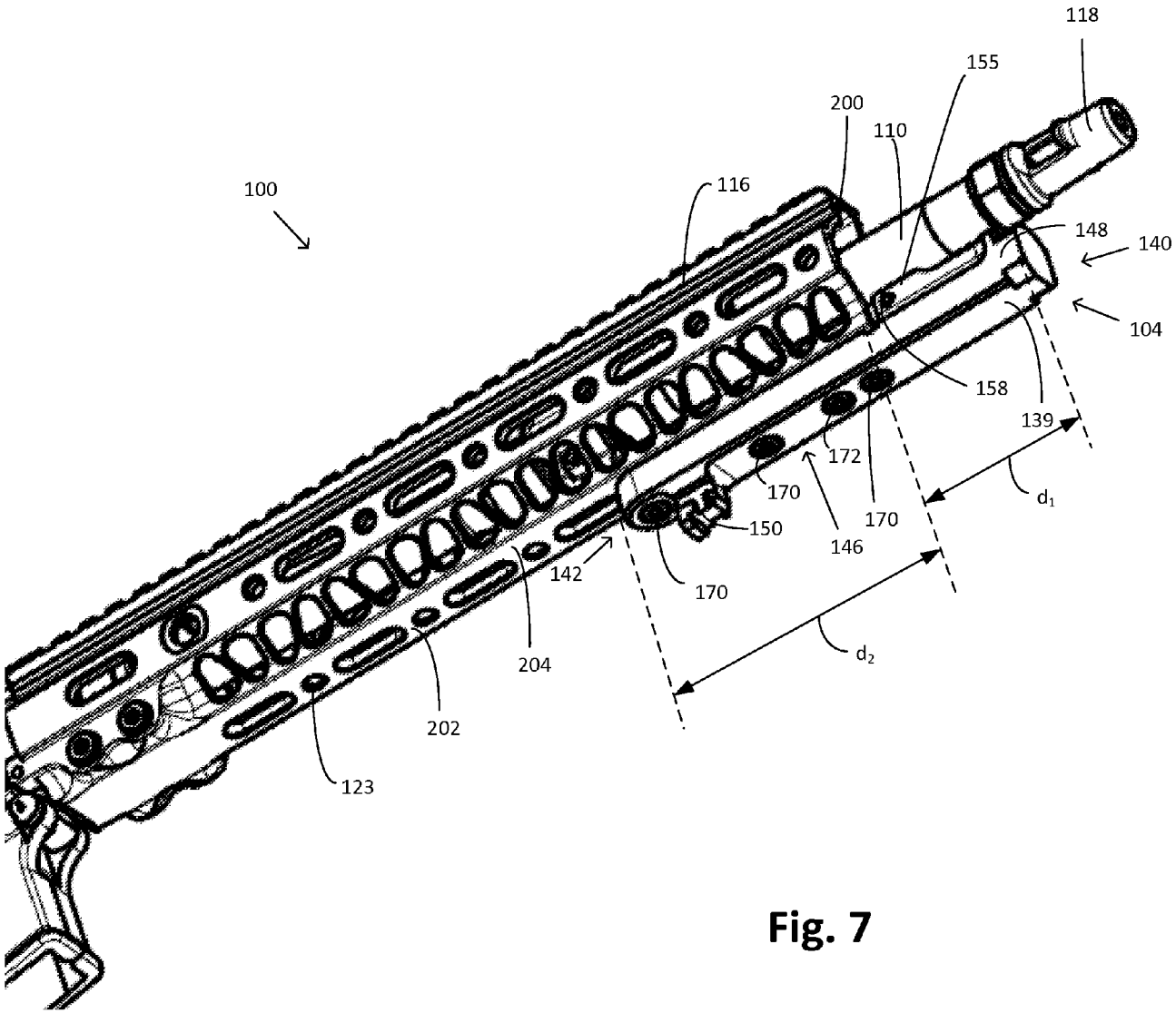
FIG. 7 is a perspective view of a portion of the firearm of FIG. 2A having the knife mount of FIG. 2A secured thereto.

FIG. 7 is a perspective view of a portion of the firearm 100 of FIG. 2A having the knife mount 104 of FIG. 2A secured thereto. The firearm 100 includes the barrel 110, the rail 116, the muzzle brake 118 and the fastener holes 123 as discussed above. The knife mount 104 includes an elongate member 139 having a front end 140, a back end 142 and a bottom 146, the knife mount 104 further including the front knife engagement portion 148, the rear knife engagement portion 150, the torque support mounting portion 155, the pin 158, the first fasteners 170, and the second fastener 172, as discussed above. In addition, in this example the rail 116 includes a front end 200, and a bottom side 202 having an exterior surface 204.

With reference to FIG. 7, with the example knife mount 104 secured to the rail 116, a forward portion of the knife mount 104 extends beyond the front end 200 of the rail 116 by a distance $d_1$ (i.e., $d_1$ corresponds to the distance between the front end 200 of the rail 116 and the front end 140 of the knife mount 104). The distance $d_1$ for the knife mount 104 may be selected from a range of values depending on factors such as the length and type of the rail 116, the length of the barrel 110 and any barrel accessories that may impact the length of the barrel 110 (e.g., a muzzle brake 118), and size and weight of a knife (e.g., the knife 102 of FIG. 2A to be secured to the knife mount 104). In some examples, the distance $d_1$ is selected such that a knife secured to the knife mount 104 as shown in FIG. 2A (and discussed above) sufficiently extends beyond the front of the barrel 110 (and any barrel accessories that impact the length of the barrel 110) for engaging a target, e.g., during combat at close range. There is also a distance $d_2$ between the back end 142 of the knife mount 104 and the front end 200 of the rail 116 when the knife mount 104 is secured to the rail 116. In some examples, the front end 200 of the rail 116 aligns with a portion of the groove 157. The distance $d_2$ may be selected from a range of values depending on factors such as the type of the rail 116 and the size and weight of a knife (e.g., the knife 102 of FIG. 2A) to be secured to the knife mount 104. In some examples, the distance $d_2$ is selected to provide sufficient interfacing between the knife mount 104 and the rail 116 to adequately secure a knife to the rail 116 for use (e.g., in close range combat). In some examples $d_1$ is in a range from about 1 cm to about 10 cm and $d_2$ is in a range from about 1 cm to about 30 cm. In a particular example, $d_1$ is approximately 5.4 cm and $d_2$ is approximately 7.5 cm. It should be noted that $d_1$ and $d_2$ may fall outside of these ranges.

The first fasteners 170 and the second fastener 172 are disposed and spaced along the elongate member 139 to align with fastener holes in the bottom side 202 of the rail 116. Unused fastener holes 123 are shown in FIG. 7. With respect to the second fastener 172, the fastener hole 166 in the torque support 154 (FIG. 6) is disposed to align with a fastener hole 162 (FIG. 6) in the elongate member 139, as well as a fastener hole in the bottom side 202 of the rail 116 when the torque support 154 is pivoted to a position that sandwiches the bottom side 202 of the rail 116 between the torque support 154 and the rail engagement surface 152 (FIG. 6) as discussed above. It should be noted that the knife mount 104 may be alternatively mounted to portions of the rail 116 other than the bottom side 200.

In this example the exterior surface 204 of the bottom side 202 of the rail 116 is convex, and the rail engagement surface 152 (FIG. 6) is correspondingly concave to provide a nesting interface between the exterior surface 204 and the rail engagement surface 152. The bottom side 202 also includes an interior surface opposite the exterior surface 204. The torque support 154 (FIG. 6) engages the interior surface of the bottom side 202 to sandwich the bottom surface 202 between the rail engagement surface 152 (FIG. 6) and the torque support 154 (FIG. 6), as discussed above.

The knife mount 104 and its various components can be molded and/or machined from a suitably strong and rigid material (e.g., steel, aluminum, polymer) to achieve the purpose and functions of the knife mount 104 discussed above.

Figure 8:
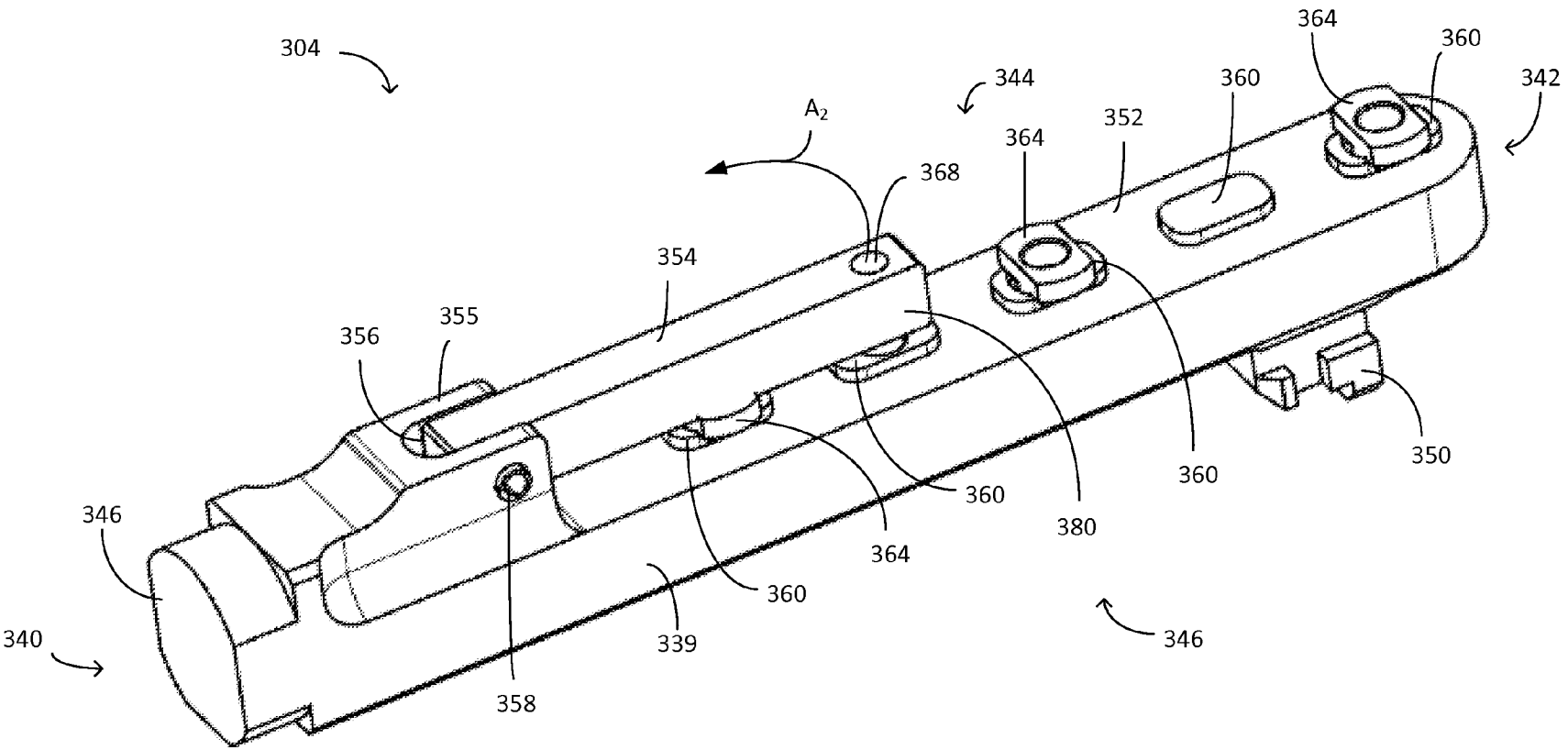
FIG. 8 is a perspective view of a further example of a knife mount in accordance with the present disclosure having a torque support in a lowered position.
Figure 9:
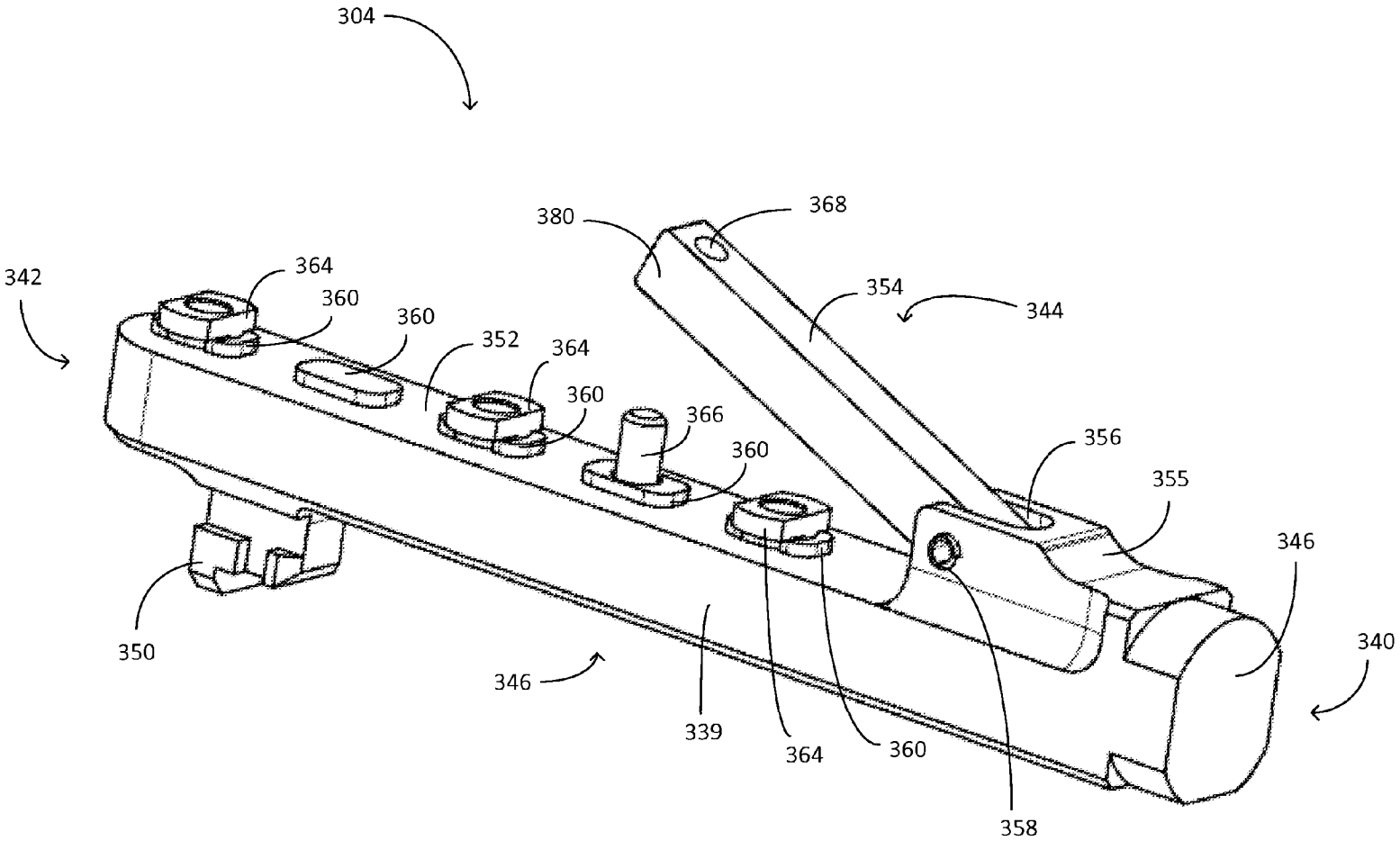
FIG. 9 is a further perspective view of the knife mount of FIG. 8 having the torque support a raised position.
Figure 10:
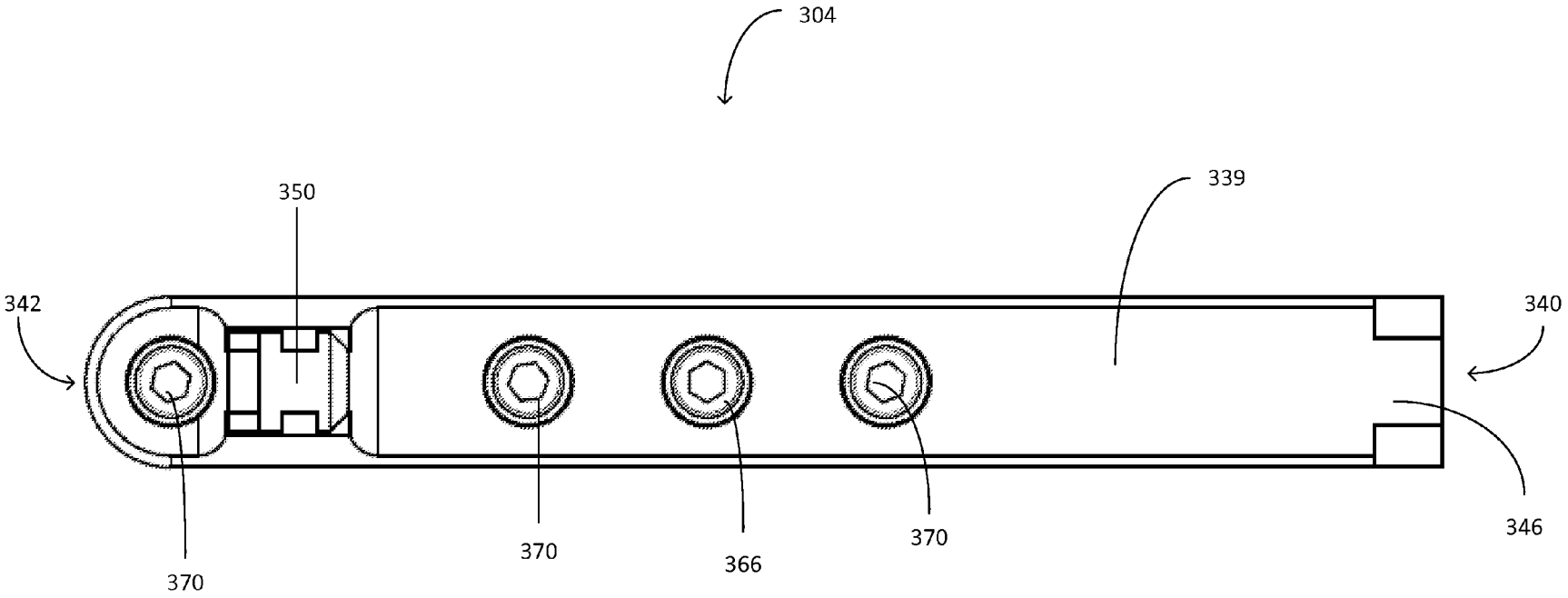
FIG. 10 is a bottom view of the knife mount of FIG. 8.

FIG. 8 is a perspective view of a further example of a knife mount 304 in accordance with the present disclosure having a torque support 354 in a lowered position. FIG. 9 is a further perspective view of the knife mount 304 of FIG. 8 having the torque support 354 in a raised position. FIG. 10 is a bottom view of the knife mount 304 of FIG. 8.

With reference to FIGS. 8-10 the knife mount 304 enables a knife (e.g., the knife 102 of FIG. 3) to be secured for engagement with a target directly to a firearm rail (e.g., the firearm rail 112 of FIG. 2A), such that the knife need not be secured to the barrel or a barrel accessory (e.g., a front sight). Thus, for example, the knife mount 304 enables mounting of a knife to a firearm even if the firearm does not have a front sight or cannot support a front sight (e.g., because it has a rail that is too long, as discussed above).

The knife mount 304 includes an elongate member 339, a front end 340, a back end 342, a top 344, a bottom 346, a front knife engagement portion 348, a rear knife engagement portion 350, a rail engagement surface 352, a torque support 354, a torque support mounting portion 355, a recess 356, a pin 358, one or more lugs 360 extending upward from the rail engagement surface 352, one or more lug heads 364, a torque support fastener 366 (FIGS. 9-10), and the torque support 354 includes a fastener receiver 368 (FIGS. 8-9). In addition, the knife mount 304 includes one or more lug head actuators 370 (FIG. 10).

The elongate member 339 defines the longitudinal length of the knife mount 304 from the front end 340 to the back end 342. The front knife engagement portion 348 engages a portion of a knife (e.g., the knife 102 in FIG. 2A). In some examples, the front knife engagement portion 348 is a forwardly projecting projection at the front end 340 of the elongate member 339 that is configured to removably house (e.g., via a frictional fit) a corresponding receiving portion of a knife (e.g., the ring 133 in FIG. 2A).

The rear knife engagement portion 350 is disposed rearward of the front knife engagement portion 348 and is configured to engage a knife (e.g., the knife 102 in FIG. 2A) at a location on the knife that is rearward of an engagement with the front knife engagement portion 348. Thus, the front knife engagement portion 348 and the rear knife engagement portion 350 together provide two points of support for securing a knife to the knife mount 304. In the example shown, the rear knife engagement portion 350 is a projection extending downwardly from a bottom surface of the elongate member 339 and configured to releasably engage a rear mounting portion of a knife (e.g., by being removably inserted in, and frictionally cooperating with, the notch 136 of the rear mounting portion 134 of the knife 102 in FIG. 3).

At least a portion of the rail engagement surface 352 is configured to abut a side (e.g., the bottom) of a firearm rail (e.g., the rail 116 of FIG. 2A) when the knife mount 304 is secured to the firearm rail. In the example knife mount 304 shown, the rail engagement surface 352 is a concave arcuate surface that cooperates with a correspondingly convex arcuate surface on a firearm rail (e.g., the rail 116 of FIG. 2A), providing a nesting cooperation between the rail engagement surface 352 and the firearm rail.

The torque support 354 is situated and configured to sandwich a portion of a firearm rail (e.g., the rail 116 of FIG. 2A) between a rail engagement surface 352 and the torque support 354. The torque support 354 is a bar configured to apply a downward force on a firearm rail (e.g., the rail 116) and thereby balance the torque experienced by the knife mount 304 as a result of the weight of a knife (e.g., the knife 102 of FIG. 2A), the weight of the knife mount 304, and/or other forces (such as forces generated when using the knife to engage a target). Thus, the torque support 354 can reduce undesirable shifting or movement of the knife mount 304 relative to the firearm 100 (FIG. 2A), and thereby reduce undesirable shifting or movement of the knife 102 (FIG. 2A) relative to the firearm 100 (FIG. 2A).

The torque support mounting portion 355 is disposed forward of, and higher than, the rail engagement surface 352. A recess 356 in the torque support mounting portion 355 houses a forward portion of the torque support 354. The torque support 354 pivotally couples to the torque support mounting portion 355 via a pin 358 inserted through holes on either side of the torque support 354. When the forward portion of the torque support 354 is free (i.e., not directly coupled to the knife mount 304 (discussed below)), the torque support 354 is pivotable about the pin 358 in the direction of the arrow $A_2$ in FIG. 8, thereby facilitating installation and removal of the knife mount 304 to or from, respectively, a rail (e.g., the rail 116 of FIG. 2A). For example, to remove the knife mount 304 from a rail, the torque support 354 is pivoted away from an interior surface of the rail such that the rail is no longer sandwiched between the torque support 354 and the rail engagement surface 352.

The one or more lugs 360 extend upward from the rail engagement surface and are configured to be inserted and thereby engage apertures (e.g., the apertures 117 of FIG. 2A) in the underside of a rail (e.g., the rail 116 of FIG. 2A). The engagement can be a loose or frictional fit and provides additional support that reduces movement of the knife mount 304 (and thereby a knife secured to the knife mount 304) relative to the rail.

Each of the lug heads 364 is disposed above a lug 360. Each of the lug heads 364 is rotatable about a vertical axis extending through the respective lug 360. Each of the lug heads 364 is coupled to a lug head actuator 370. Each of the lug head actuators 370 extends through a lug 360 and vertically through a side of the elongate member 339. The lug head actuators 370 are rotatable about a vertical axis. The lug head actuators 370 can be rotated, e.g., by rotatably engaging a bottom portion thereof (e.g., manually, with a screw driver, a wrench or other tool) to move the lug heads 364 between an aligned position and an unaligned position. In the aligned position, the lug head 364 is aligned with (i.e., parallel to) its respective lug 360. In an unaligned position the lug head 364 is not aligned with its respective lug 360. An example unaligned position is shown in FIGS. 8-9, in which the lug heads 364 are perpendicular to their respective lugs 360.

The torque support fastener 366 (e.g., a screw, a bolt, a pin) passes through the elongate member 339 and optionally a lug 360 in a vertical direction and removably engages the fastener receiver 368 (e.g., a screw hole, bolt hole, pin hole) for detachably securing the back portion 380 (FIGS. 8-9) of the torque support 354 to the elongate member 339.

To secure the knife mount 304 to a firearm rail (e.g., the rail 116 of FIG. 2A), the lug heads 364 are aligned with the lugs 360, allowing the lugs 360 with their lug heads 364 to be inserted into apertures (e.g., the apertures 117 of FIG. 2A) in the side of a rail. Once inserted, the lug heads 364 are rotated (e.g., by rotating the lug head actuators 370) until the lug heads are in unaligned position (e.g., perpendicular to the lugs 360). The unaligned position sandwiches a side of the rail between the rail engagement surface 352 and the lug heads 364, preventing the lugs 360 from disengaging the apertures in the rail, and thereby securing the knife mount 304 to the rail. Optionally, to further secure the rail, the torque support 354 is lowered and the torque support fastener 366 is fastened to the fastener receiver 368, thereby providing an additional clamping of the knife mount 304 to the rail.

To remove the knife mount 304 from a rail, the torque support fastener 366 is disengaged from the fastener receiver 368, and each of the lug heads 364 is rotated into an aligned position with its respective lug 360, allowing the knife mount 304 to be de-coupled from the rail (e.g., the rail 116 of FIG. 2A) and its apertures (e.g., the apertures 117 of FIG. 2A).

The number and spacing of the lugs 360 and their lug heads 364 may be varied in accordance with the configuration of the rail being used and the amount and location of engagement desired between the knife mount 104 and the rail. In addition, the shape and size of the lugs 360 and their lug heads 364 may be adjusted for different rails and rail apertures.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A knife mount for a firearm comprising:

an elongate member defined by a front end and a back end;

a knife engagement portion disposed on the elongate member;

a rail engagement surface disposed on the elongate member, the rail engagement surface being configured to be removably secured to a firearm rail; and a bar disposed adjacent the rail engagement surface, the firearm rail being removably sandwiched between the bar and the rail engagement surface.

2. The knife mount of claim 1, wherein the elongate member further comprises a bar mounting portion, the bar being pivotally coupled to the bar mounting portion.

3. The knife mount of claim 2, further comprising a fastener, wherein the elongate member comprises a first fastener hole, the firearm rail comprises a second fastener hole, and the bar comprises a third fastener hole, and wherein the bar is pivotable into a position such that the first fastener hole, the second fastener hole and the third fastener hole are aligned for receiving the fastener.

4. The knife mount of claim 1, wherein the elongate member further comprises at least one protrusion extending from the rail engagement surface for removably engaging an aperture in a side of the firearm rail.

5. The knife mount of claim 1, further comprising a groove, the groove being disposed such that the groove aligns with a front end of the firearm rail when the knife mount is secured to the firearm rail.

6. The knife mount of claim 1, wherein the rail comprises a front end, and wherein when the knife mount is secured to the rail, a first section of the knife mount extends forward from the front end of the rail and a second section of the knife mount extends rearward from the front end of the rail.

7. The knife mount of claim 6, wherein the first section extends forward such that a portion of a knife secured to the first knife engagement portion, and the second knife engagement portion extends forward beyond a barrel of the firearm.

8. The knife mount of claim 1, wherein the rail engagement surface is a top surface of the knife mount, and wherein the knife engagement portion extends downward from a bottom surface of the knife mount.

9. The knife mount of claim 1, further comprising at least one fastener and at least one protrusion, the at least one fastener being configured to engage a fastener hole in a side of the rail, and the protrusion being configured to engage at least one air vent in a side of the rail.

10. The knife mount of claim 1, wherein the firearm rail is a handguard and the knife mount is fastened to the handguard.

11. A firearm comprising:

a barrel;

a rail disposed about the barrel;

a knife;

a knife mount, the knife mount comprising an elongate member defined by a front end and a back end, a knife engagement portion, and a rail engagement surface disposed on the elongate member, the rail engagement surface being configured to be removably secured to the rail, and the knife engagement portion being configured to be removably secured to the knife; and a bar disposed adjacent the rail engagement surface, the rail being removably sandwiched between the bar and the rail engagement surface.

12. The firearm of claim 11, wherein the knife mount further comprises a bar mounting portion, the bar being pivotally coupled to the bar mounting portion.

13. The firearm of claim 12, wherein the knife mount further comprises a fastener, wherein the elongate member further comprises a first fastener hole, the rail comprises a second fastener hole, and the bar comprises a third fastener hole, and wherein the bar is pivotable into a position such that the first fastener hole, the second fastener hole and the third fastener hole are aligned for receiving the fastener.

14. The firearm of claim 13, wherein the elongate member further comprises at least one protrusion extending from the rail engagement surface for removably engaging an aperture in a side of the rail.

15. The firearm of claim 11, wherein the knife mount further comprises a groove, the groove being disposed such that the groove aligns with a front end of the rail when the knife mount is secured to the rail.

16. The firearm of claim 11, wherein the rail comprises a front end, and wherein when the knife mount is secured to the rail, a first section of the knife mount extends forward from the front end of the rail and a second section of the knife mount extends rearward from the front end of the rail.

17. The firearm of claim 16, wherein the first section extends forward such that a portion of the knife secured to the knife engagement portion extends forward beyond the barrel.

18. The firearm of claim 11, wherein the rail engagement surface is a top surface of the knife mount, and wherein the knife engagement portion extends downward from a bottom surface of the knife mount.

19. The firearm of claim 11, wherein the rail is a handguard.

20. A firearm comprising:

a barrel;

a rail disposed about the barrel; and a knife mount, the knife mount comprising an elongate member defined by a front end and a back end, a first knife engagement portion disposed at a first portion of the elongate member, a second knife engagement portion disposed at a second portion of the elongate member, and a rail engagement surface disposed on the elongate member, the rail engagement surface being configured to be removably secured to the rail, and the knife engagement portion being configured to be removably secured to a knife, the knife mount further comprising a torque balancing bar disposed above the rail engagement surface, the rail being removably sandwiched between the torque balancing bar and the rail engagement surface, and the bar being pivotally coupled to the elongate member.

* * * * *